US007384185B2

(12) United States Patent
Melander et al.

(10) Patent No.: US 7,384,185 B2
(45) Date of Patent: Jun. 10, 2008

(54) APPARATUS FOR MIXING A CHEMICAL MEDIUM WITH A PULP SUSPENSION

(75) Inventors: Olof Melander, Sundsvall (SE); Peter Danielsson, Fagervik (SE); Tomas Wikström, Sundsvall (SE)

(73) Assignee: Metso Paper, Inc. (FI)

( * ) Notice: Subject to any disclaimer, the term of this patent is extended or adjusted under 35 U.S.C. 154(b) by 259 days.

(21) Appl. No.: 10/537,939

(22) PCT Filed: Dec. 8, 2003

(86) PCT No.: PCT/SE03/01907

§ 371 (c)(1),
(2), (4) Date: Oct. 17, 2005

(87) PCT Pub. No.: WO2004/052517

PCT Pub. Date: Jun. 24, 2004

(65) Prior Publication Data

US 2006/0140049 A1 Jun. 29, 2006

(30) Foreign Application Priority Data

Dec. 12, 2002 (SE) ..... 0203678

(51) Int. Cl.
*B01F 7/04* (2006.01)
*B01F 15/02* (2006.01)

(52) U.S. Cl. ..... 366/171.1; 366/172.1; 366/172.2; 366/307; 366/325.2

(58) Field of Classification Search ..... 366/168.1, 366/172.1, 172.2, 171.1, 325.2, 306–307; 162/57, 243
See application file for complete search history.

(56) References Cited

U.S. PATENT DOCUMENTS 3,503,846 A * 3/1970 Nardi Franco ..... 162/236

(Continued)

FOREIGN PATENT DOCUMENTS

EP 297464 A2 * 1/1989

(Continued)

OTHER PUBLICATIONS

Sunds Defibrator AB's Marknadsforingsmaterial SMA Mixers (tryckt av Reklammakarna/Tryckeribolaget Sundsvall AB 1984.

(Continued)

*Primary Examiner*—Charles E. Cooley
(74) *Attorney, Agent, or Firm*—Lerner, David, Littenberg, Krumholz & Mentlik, LLP

(57) ABSTRACT

The present invention relates to an apparatus for mixing of a chemical medium in gaseous or liquid state with a pulp suspension. The apparatus comprises a housing having a wall (2) that defines a mixing chamber (4), a first feeder (6) for feeding the pulp suspension to the mixing chamber, a rotor shaft (8, 104, 204, 300, 406, 502), that extends in the mixing chamber, a drive device for rotation of the rotor shaft, a rotor body (10, 200, 407, 504), that is connected to the rotor shaft and arranged to supply kinetic energy to the pulp suspension flow, during rotation of the rotor shaft by the rotation of the drive device, such that turbulence is produced in a turbulent flow zone (12) in the mixing chamber, a second feeder (13) for feeding of the chemical medium to the mixing chamber, and an outlet for discharging the mixture of chemical medium and pulp suspension from the mixing chamber.

23 Claims, 5 Drawing Sheets

U.S. PATENT DOCUMENTS

| | | | | |
|---|---|---|---|---|
| 4,339,206 | A | 7/1982 | Ahs | |
| 4,416,548 | A | 11/1983 | Carre et al. | |
| 4,577,974 | A | 3/1986 | Prough et al. | |
| 4,877,368 | A * | 10/1989 | Timperi et al. | 415/143 |
| 5,088,831 | A | 2/1992 | Reinhall | |
| 5,263,774 | A * | 11/1993 | Delcourt | 366/305 |
| 5,378,321 | A * | 1/1995 | Delcourt | 162/57 |
| 5,711,852 | A | 1/1998 | Ekholm et al. | |
| 5,791,778 | A * | 8/1998 | Manninen et al. | 366/171.1 |
| 5,813,758 | A * | 9/1998 | Delcourt et al. | 366/171.1 |
| 5,863,120 | A * | 1/1999 | Gallagher et al. | 366/171.1 |
| 6,254,335 | B1 | 7/2001 | Ekholm et al. | |
| 2006/0133195 | A1 * | 6/2006 | Melander et al. | 366/170.3 |
| 2006/0140049 | A1 * | 6/2006 | Melander et al. | 366/171.1 |

FOREIGN PATENT DOCUMENTS

| | | | |
|---|---|---|---|
| EP | 0 664 150 | B1 | 7/1995 |
| WO | WO 8700450 | A1 * | 1/1987 |

OTHER PUBLICATIONS

Sunds Defibrator AB's Marknadsforingsmaterial SM Mixers (tryckt av Reklammakarna/Tyckeribolaget Sundsvall AB 1989.
Sundsvall Defibrator AB's Marknadsforingsmaterial SM Mixer (tryckt av Reklammakarna/Tryckeribolaget Sundsvall AB 1990.
"Dual Mixers", Kvaerner Pulping AB, date unknown.
Tappi, Chemical Pulping Book 6A, p. A629 (1999).

* cited by examiner

APPARATUS FOR MIXING A CHEMICAL MEDIUM WITH A PULP SUSPENSION

FIELD OF THE INVENTION

The present invention relates to an apparatus for mixing of a chemical medium in gas gaseous or liquid state wit a pulp suspension.

BACKGROUND OF THE INVENTION

In the treatment of pulp suspensions there is a need for intermixture of different media for treatment, for example, for heating or bleaching purposes. Therefore, it is desirable to disperse the medium in the pulp suspension during simultaneous conveyance of the pulp suspension through a pipe. European Patent No. 664,150 discloses apparatus for this function. For heating of pulp suspensions, steam is added which condenses and thus gives off its energy content to the pulp suspension. A bleaching agent is added during bleaching that reacts with the pulp suspension. In connection with the treatment of recovered fiber pulp printing ink is separated by floatation, which means that air must previously be disintegrated in the pulp suspension such that the hydrophobic ink, or the printing ink, may attach to the rising air bubbles. In this connection it is desirable that the medium for treatment, e.g. air, is evenly and homogeneously distributed in the pulp suspension, preferably with tiny bubbles to achieve a large surface against the pulp suspension.

In all cases it is difficult, with proportionately low addition of energy, to achieve an even intermixture of the medium in the flow of material. When heating pulp suspensions by the supply of steam to a pulp pipe, problems often arise with large steam bubbles that are formed on the inside of the pipe, and this as a consequence of a non-disintegrated gas with a small condensation surface. When these large steam bubbles rapidly implode, condensation forces arise that cause vibrations in the pipe, and in the following equipment. This phenomenon limits the amount of steam that can be added to the system and thus the desired increase in temperature. It is hard to achieve a totally even temperature profile in the pulp suspension when large steam bubbles exist. In order to remedy these problems, a large amount of energy can be supplied to carefully admix the steam in the pulp suspension. Another variant is to disintegrate the steam already supplied with the pulp suspension. In the intermixing of bleaching agents in a pulp suspension, relatively large amounts of energy are used in order to provide that the bleaching agent is evenly distributed and conveyed to all the fibers in the pulp suspension. The energy requirements are controlled by which bleaching agent is to be supplied (rate of diffusion and reaction velocity) and also by the phase of the bleaching medium (liquid or gas). The geometry during supply of the bleaching agent in the vapor phase is important in order to avoid unwanted separation immediately after the intermixture.

One object of the present invention is to provide an apparatus for supplying and intermixing of a chemical medium in a pulp suspension in an effective way and that at least partly eliminates the above mentioned problem.

SUMMARY OF THE INVENTION

These and other objects are achieved with an apparatus for mixing of a chemical medium in gaseous or liquid state with a pulp suspension according to the present invention. The apparatus comprises a housing having a wall that defines a mixing chamber and a first feeder for feeding the pulp suspension to the mixing chamber. Further, the apparatus comprises a rotor shaft that extends in the mixing chamber, a drive device for rotation of the rotor shaft and a rotor body that is connected to the rotor shaft. The rotor body is arranged to supply kinetic energy to the pulp suspension flow during rotation of the rotor shaft by the rotation of the drive device, such that turbulence is produced in a turbulent flow zone in the mixing chamber. The apparatus also comprises a second feeder for feeding of the chemical medium to the mixing chamber and an outlet for discharging the mixture of chemical medium and pulp suspension from the mixing chamber. The apparatus is characterised by that the second feeder comprises at least one stationary feeding pipe that extends from the wall of the housing into the mixing chamber and that has an outlet for the chemical medium in or in close vicinity to said turbulent flow zone.

In that respect, in accordance with present invention, an even and effective intermixing of the chemical medium in the pulp suspension is provided.

Further features and advantages according to embodiments of the apparatus according to the present invention are evident from the claims and in the following from the description.

BRIEF DESCRIPTION OF THE DRAWINGS

The present invention shall now be described more in detail in embodiments in the following detailed description, with reference to the accompanying drawings, without restricting the interpretation of the invention thereto, where.

DETAILED DESCRIPTION

Figure 1:
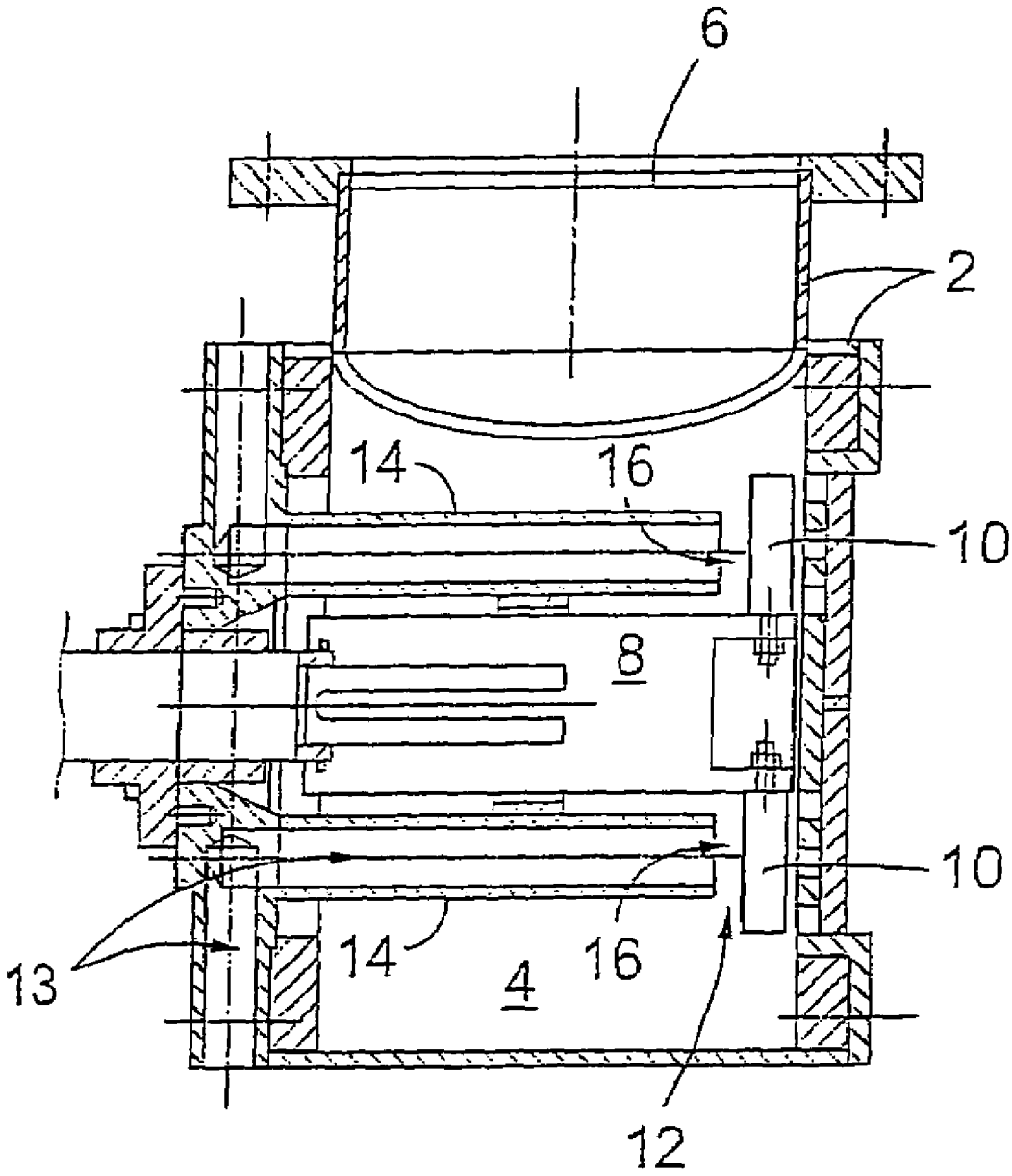
FIG. 1 is a side, elevational, cross-sectional view of an apparatus according to an embodiment of the present invention.

In FIG. 1 is shown an apparatus according to an embodiment of the present invention. The apparatus comprises a housing with a wall 2 that defines a mixing chamber 4 and a first feeder 6 for supplying a pulp suspension to the mixing chamber. Further, the apparatus comprises a rotor shaft 8, which extends in the mixing chamber 4, a drive device (not shown) for rotation of the rotor shaft and a rotor body 10 that is connected to the rotor shaft 8. The rotor body is arranged to supply kinetic energy to the pulp suspension flow during rotation of the rotor shaft by rotation of the drive device, such that turbulence is produced in a turbulent flow zone 12 in the mixing chamber. The apparatus also comprises a second feeder 13 for feeding the chemical medium to the mixing chamber and an outlet (not shown) for discharging the mixture of chemical medium and pulp suspension from the mixing chamber 4. The second feeder 13 comprises at least one stationary feeding pipe 14, that extends from the wall 2 of the housing into the mixing chamber 4 and that has an outlet 16 for the chemical medium in or in close vicinity to the turbulent flow zone 12. The second feeder 13 may comprise a number of stationary feeding pipes 14, as is evident from FIG. 1, that extends substantially parallel to the rotor shaft 8 in the mixing chamber. Further, according to an embodiment not shown herein, the feeding pipes 14 may extend substantially radially with respect to the rotor shaft 8 in the mixing chamber.

Figure 2A:
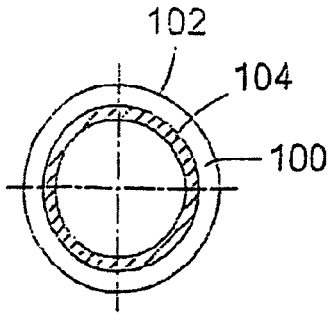
FIG. 2A is a front, elevational, cross-sectional view of a rotor shaft extending through a feeding pipe, which is coaxially arranged with the rotor shaft in the apparatus of the present invention.
Figure 2B:
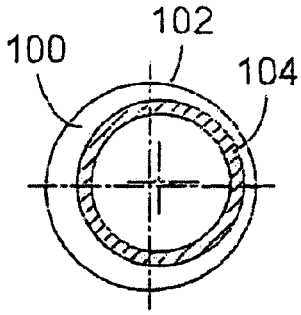
FIG. 2B is a front, elevational, cross-sectional view of a rotor shaft extending through a feeding pipe, which is eccentrically arranged with the rotor shaft in the apparatus of the present invention.

In the case where the feeding pipe 14 extends parallel to the rotation shaft, the rotation shaft 8 may extend through the feeding pipe 14, whereby an annular outlet for chemical medium is defined by the rotor shaft 8 and the feeding pipe 14. In that respect, a feeding pipe 102 can extend coaxially as shown in FIG. 2A, or eccentrically to a rotor shaft 104 as shown in FIG. 2B, whereby an annular outlet 100 for the chemical medium is defined by the rotor shaft 104 and the feeding pipe 102.

Figure 3A:
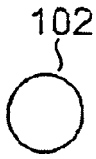
FIG. 3A is a front, elevational, cross-sectional view of one alternative outlet of a feeding pipe in accordance with the present invention.
Figure 3B:
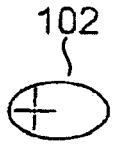
FIG. 3B is a front, elevational, cross-sectional view of another alternative outlet of a feeding pipe in accordance with the present invention.
Figure 3C:
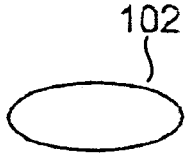
FIG. 3C is a front, elevational, cross-sectional view of another alternative outlet of a feeding pipe in accordance with the present invention.
Figure 3D:
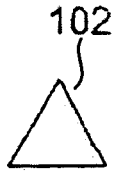
FIG. 3D is a front, elevational, cross-sectional view of another alternative outlet of a feeding pipe in accordance with the present invention.
Figure 3E:
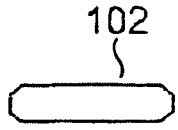
FIG. 3E is a front, elevational, cross-sectional view of another alternative outlet of a feeding pipe in accordance with the present invention.

The outlet 16, 100 of the feeding pipe is suitably of a rotationally symmetrical design, such as a circular form as shown in FIG. 3A. The outlet of the feeding pipe may also be of other non-rotational symmetrical designs, e.g. elliptical according to FIGS. 3B-C, triangular according to FIG. 3D, or a rectangular form as shown in FIG. 3E.

Figure 4A:
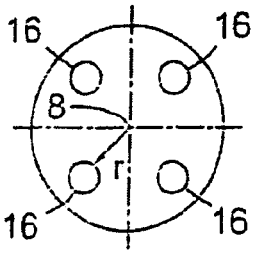
FIG. 4A is a front, elevational, view of a symmetrical arrangement of an outlet of a feeding pipe around a rotor shaft in accordance with the present invention.
Figure 4B:
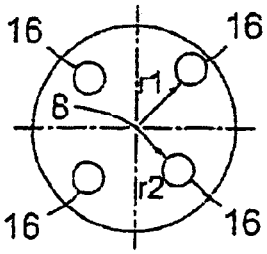
FIG. 4B is a front, elevational view of an asymmetrical arrangement of an outlet of a feeding pipe around a rotor shaft in accordance with the present invention.
Figure 4C:
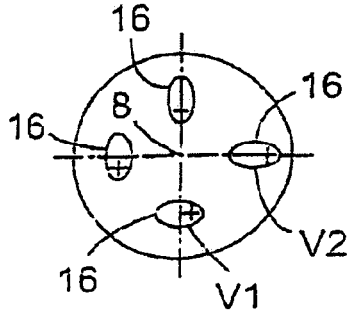
FIG. 4C is a front, elevational view of a non-rotational symmetrical outlet of a feeding pipe around a rotor shaft in accordance with the present invention.

In the case where the second feeder comprises a number of stationary feeding pipes 14, the outlets 16 of the feeding pipes 14 can be situated symmetrically, an equal distance R from the rotor shaft 8, as shown in FIG. 4A, or asymmetrically around the rotor shaft 8, with different distances R1 and R2, respectively, from the rotor shaft 8, as shown in FIG. 4B. In the case where the outlets 16 of the feeding pipes, respectively, are non-rotationally symmetrically designed, at least one of the outlets 16 can be provided with an orientation of rotation V1 in relation to the center of the rotor shaft that differs from the corresponding orientations of rotation V2 of the other outlets, as is evident from FIG. 4C.

Figure 5:
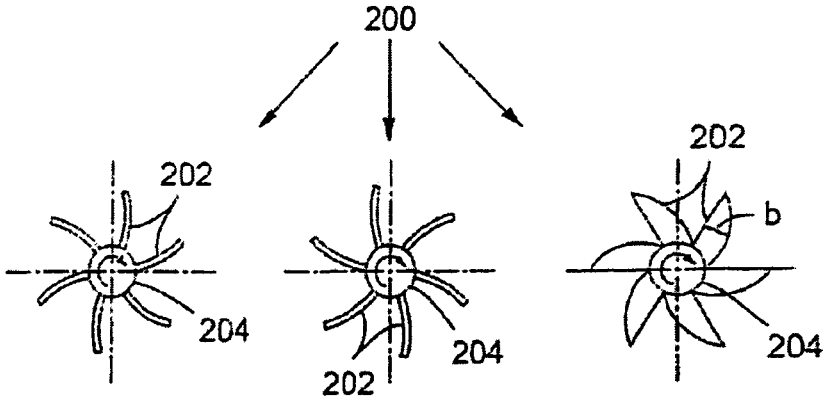
FIG. 5A is a front, elevational, cross-sectional view of one embodiment of rotor pins in cross-sectional of the rotor shaft in accordance with the present invention.
FIG. 5B is a front, elevational, cross-sectional view of another embodiment of rotor pins in cross-section of the rotor shaft in accordance with the present invention.
FIG. 5C is a front, elevational, cross-sectional view of another embodiment of rotor pins in cross-section of the rotor shaft in accordance with the present invention.
Figure 6:
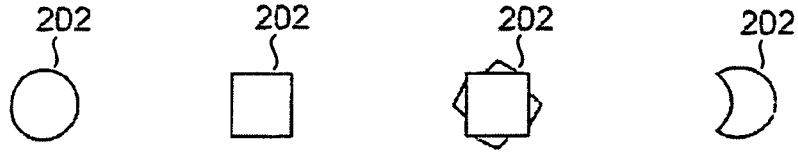
FIG. 6A is a front, elevational, cross-sectional view of one rotor pin according to the present invention.
FIG. 6B is a front, elevational, cross-sectional view of another rotor pin according to the present invention.
FIG. 6C is a front, elevational, cross-sectional view of another rotor pin according to the present invention.
FIG. 6D is a front, elevational, cross-sectional view of another rotor pin according to the present invention.

FIGS. 5A-C illustrate that a rotor body 200 according to the present invention may comprise a number of rotor pins 202, which extends from the rotor shaft 204 in its radial direction. Each rotor pin may be curved forwardly from the rotor shaft (FIG. 5A) or backwardly (FIG. 5B) relative to the rotational direction of the rotor body (see arrow in FIGS. 5A-C), both of which embodiments aim to provide a radial conveyance of the mixture. According to an alternative embodiment shown in FIG. 5C, each rotor pin may have a width b, as seen in the rotational direction of the rotor body, that increase along at least a part of the rotor body in a direction against the rotor shaft 204. The embodiment according to FIG. 5C decreases the opened area, and thereby the axial flow velocity increases. The rotor pins 202 can be provided with varying cross-sections as illustrated in FIGS. 6A-D. Each rotor pin may be designed with a circular cross-section as shown in FIG. 6A, which is simple from a manufacturing viewpoint and a cost efficient design. The rotor pins 202 may also be provided with a triangular or quadratic cross-section, according to FIGS. 6B-C, which geometry creates a dead air space during rotation of the rotor shaft. According to yet another embodiment the rotor pins may be provided with a shovel-shaped cross-section according to FIG. 6D, which results in a sling-effect during rotation of the rotor shaft. In addition, as is evident from FIG. 6C, each rotor pin may be designed with a helix shape, suitably with a quadratic cross-section, in the axial direction of the rotor pin. Which one of the various designs of the cross-sections of the rotor pins 202 are most preferable depends on the current flow resistance.

Figure 7:
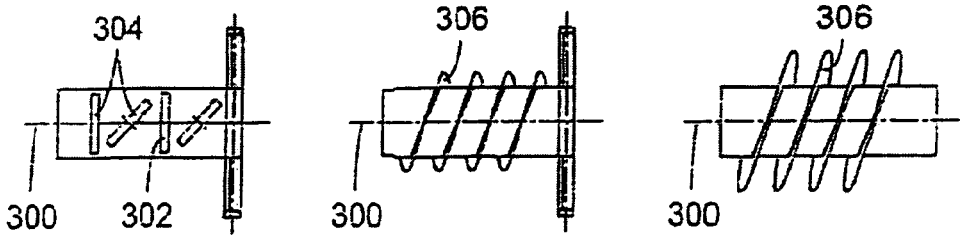
FIG. 7A is a side, elevational, schematic view of one rotor shaft provided with axial flow-generating elements according to the present invention.
FIG. 7B is a side, elevational, schematic view of another rotor shaft provided with axial flow-generating elements according to the present invention
FIG. 7C is a side, elevational, schematic view of another rotor shaft provided with axial flow-generating elements according to the present invention

FIGS. 7A-C show alternative embodiments of a rotor shaft 300 provided with one or more axially flow generating elements 302. As is shown in FIG. 7A, the axial flow-generating element can comprise a number of blades 304, which are obliquely attached relative to the rotor shaft. Rotation of the rotor shaft causes an axial flow. If the elements are of various rotational orientations along the rotor shaft as shown in FIG. 7A, different directions of flow are obtained as well. In addition, the axial flow-generating element can comprise a screw thread or a band thread 306, according to alternative embodiments shown in FIGS. 7B-C, which extends along the rotor shaft 300, that aims to force the fluid closest to the hub of the rotor shaft towards some direction. For feeding, the height of the band can suitably be about 5 to 35 mm. According to an alternative embodiment the axial flow-generating element can comprise a relatively thin elevation of about 3 to 6 mm on the surface of the shaft, suitably about 3.8 to 5.9 mm. This scale of lengths is suitable when it corresponds to the characteristic size of the fiber-flocks for kraft pulp at current process conditions. Thus, this should be variable in the process. The size of the flocks can be said to be in inverse proportion to the total work that is added to the fibre suspension. Screw thread or band thread may be used also when the rotor shaft extends through the feeding pipe as shown in embodiments in FIGS. 2A and B, if the height of the band is relatively short.

Figure 8A:
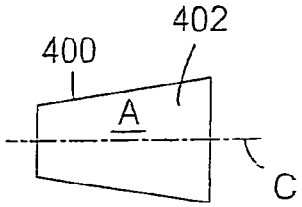
FIG. 8A is a top, elevational, schematic view of one flow passage of a flow-restraining disk according to the present invention.
Figure 8B:
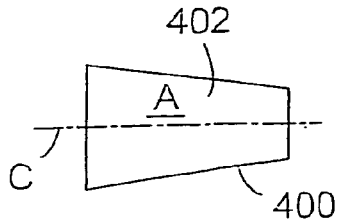
FIG. 8B is a top, elevational, schematic view of another flow passage of a flow-restraining disk according to the present invention.
Figure 8C:
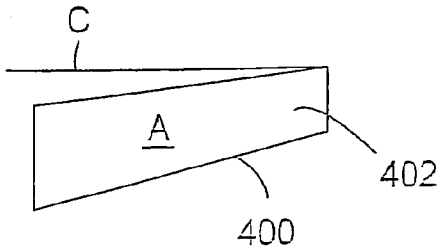
FIG. 8C is a top, elevational, schematic view of another flow passage of a flow-restraining disk according to the present invention.
Figure 8D:
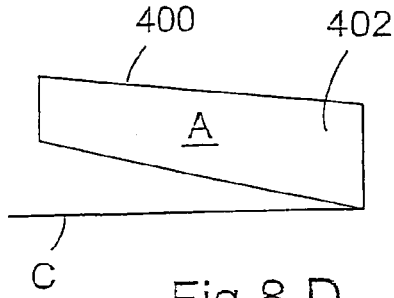
FIG. 8D is a top, elevational, schematic view of another flow passage of a flow-restraining disk according to the present invention.

Preferably, the apparatus comprises a flow-restraining disk 400 with on or more flow passages, having a constant axial area, arranged to temporarily increase the flow velocity of the pulp suspension when the pulp suspension passes the flow-restraining disk. The purpose of the disk is to create a controlled fall of pressure. The energy is used for static mixing and the disk is designed for varying pressure recovery depending on the desired energy level. FIGS. 8A-D shows different alternative embodiments of flow passages 402 in the axial direction of a flow-restraining disk 400. The flow area A of each flow passage increases or decreases in the direction of the flow, which in particular is shown in FIGS. 8A-B. FIG. 8A shows a divergent opening, i.e. that an open area enlarges in the axial direction. FIG. 8B shows a converging opening, i.e. where the open area diminish in the axial direction. As shown in FIGS. 8C-D, each flow passage can extend obliquely from the up-stream side of the disk against the center axis C of the disk.

Figure 9A:
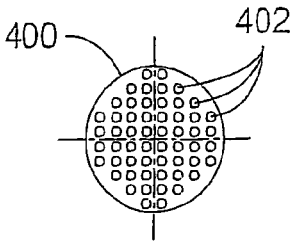
FIG. 9A is a front, elevational view of one pattern of flow passages for a flow-restraining disk according to the present invention.
Figure 9B:
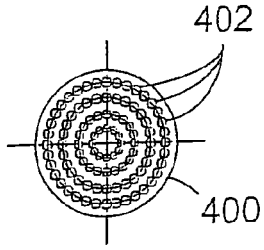
FIG. 9B is a front, elevational view of another pattern of flow passages for a flow-restraining disk according to the present invention.
Figure 9C:
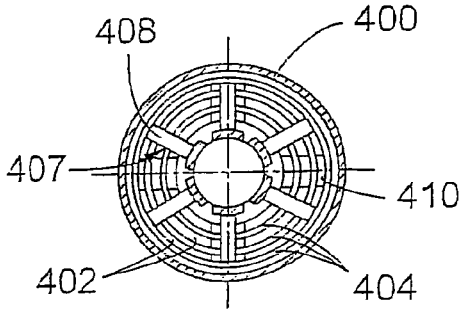
FIG. 9C is a front elevational view of another flow-restraining disk, in the axial direction, comprising concentrical rings which are coaxial with a rotor shaft.

The flow-restraining disk 400 is preferably provided with a plurality of flow passages 402 as shown in FIGS. 9A-C, which passages can be arranged according to a number of alternative placement patterns, radially spread out on the flow-restraining disk. The disk is preferably circular or coaxial with the rotor shaft. The flow passages of the flow-restraining disk may for example form a Cartesian pattern (FIG. 9A) which provides asymmetrical jet streams, or a polar pattern (FIG. 9B). FIG. 9C shows an alternative embodiment where the flow passages 402 of the flow-restraining disk 400 in the axial direction are formed of concentrical rings 404 that are coaxial with a rotor shaft 406, and its rotor body 407, which may comprise one or more rotor pins 408, arranged at a distance from and ahead of disk 400. The flow-restraining disk is suitably stationarily arranged in the housing and the disk may comprise a number of concentric rings 404, which are coaxial with the rotor shaft 406, and at least one radial bar 410, that fixes the rings 404 relative to each other, and that are attached to the wall of the housing, whereby the flow passages 402 are defined by the rings and the bar.

Figure 10A:
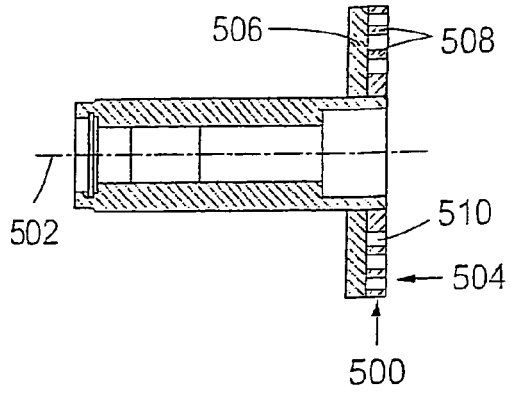
FIG. 10A is a side, elevational, cross-sectional view of one flow-restraining disk integrated with the rotor shaft according to the present invention.
Figure 10B:
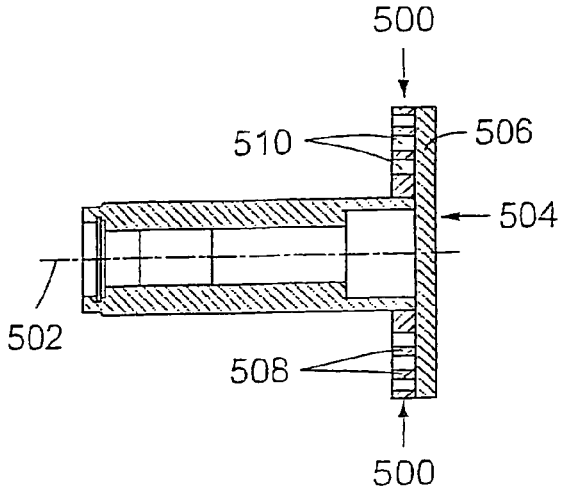
FIG. 10B is a side, elevational, cross-sectional view of another flow-restraining disk integrated with the rotor shaft according to the present invention.
Figure 10C:
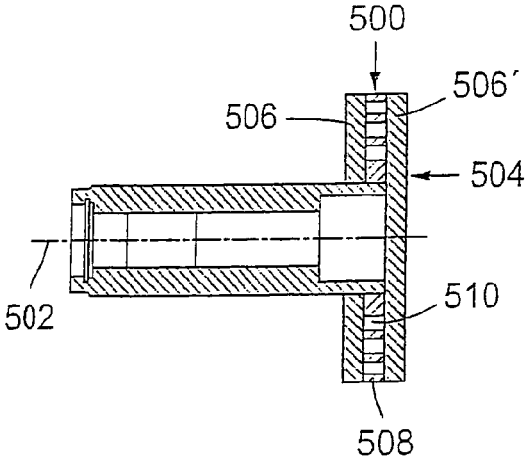
FIG. 10C is a side, elevational, cross-sectional view of another flow-restraining disk integrated with the rotor shaft according to the present invention.
Figure 10D:
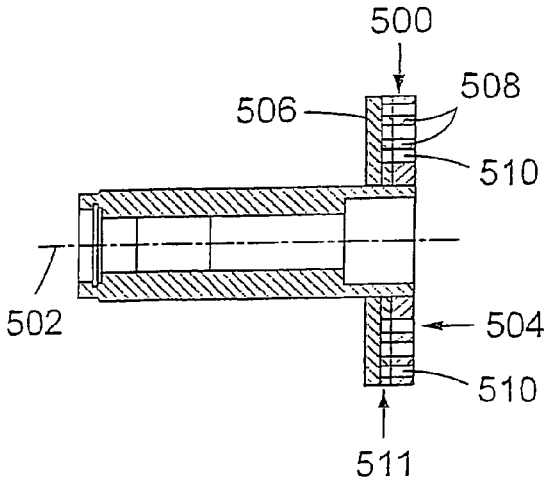
FIG. 10D is a side, elevational, cross-sectional view of another flow-restraining disk integrated with the rotor shaft according to the present invention.

However, a flow-restraining disk 500 can be integrated with the rotor shaft 502. FIGS. 10A-D illustrate alternative embodiments of flow-restraining disks 500 integrated with the rotor shaft 502. The rotor body 504 may suitably comprise a number of rotor pins 506, which extend from the rotor shaft 502, whereby the disk is fixed to the rotor pins 506 on the down-stream side of the rotor body as shown in FIG. 10A, or on its up-stream side as shown in FIG. 10B. As shown in FIG. 10C, the rotor body may comprise an additional number of pins 506', that extend from the rotor shaft on the down-stream side of the disk, whereby the disk 500 is also fixed to the additional pins 506'. Preferably the disk comprise a number of concentrical rings 508, which are coaxial with the rotor shaft, and the rotor pins, 506, 506', fix the rings 508 in relation to each other, whereby flow passages 510 are defined by the pins and the rings. FIG. 10D shows rotor pins 506 and concentrical rings 500. Further, spacer elements 511 are arranged between the rotor pins 506 and the concentrically rings 500. The spacer elements are used in order to move the turbulent zone.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. Apparatus for mixing of a chemical medium in gaseous or liquid state with a pulp suspension, comprising a housing having a wall that defines a mixing chamber, a first feeder for feeding the pulp suspension to the mixing chamber, a rotor shaft, that extends in the mixing chamber, a drive device for rotation of the rotor shaft, a rotor body, that is connected to the rotor shaft and arranged to supply kinetic energy to the pulp suspension, during rotation of the rotor shaft by the rotation of the drive device, such that turbulence is produced in a turbulent flow zone in the mixing chamber, a second feeder for feeding of the chemical medium to the mixing chamber, an outlet for discharging the mixture of chemical medium and pulp suspension from the mixing chamber, and a flow-restraining disk with one or more flow passages arranged in the outlet from the mixing chamber to temporarily increase the flow velocity of the pulp suspension when the pulp suspension passes the flow-restraining disk, the second feeder comprising at least one stationary feeding pipe that extends from the wall of the housing into the mixing chamber, including an outlet for the chemical medium in or in close vicinity to said turbulent flow zone, and the rotor body comprising a number of rotor pins which extend from the rotor shaft on the upstream side of the flow-restraining disk.

2. Apparatus according to claim 1, wherein the feeding pipe extends substantially radially to the rotor shaft in the mixing chamber.

3. Apparatus according to claim 1, wherein the feeding pipe extends substantially parallel to the rotor shaft in the mixing chamber.

4. Apparatus according to claim 3, wherein the rotor shaft extends through the feeding pipe, whereby an annular outlet for the chemical medium is defined by the rotor shaft and the feeding pipe.

5. Apparatus according to claim 4, wherein the feeding pipe extends coaxially or eccentrically to the rotor shaft.

6. Apparatus according to claim 1, wherein the second feeder comprises a number of stationary feeding pipes.

7. Apparatus according to claim 6, wherein the feeding pipes extend substantially radially to the rotor shaft.

8. Apparatus according to claim 6, wherein the feeding pipes extend substantially parallel to the rotor shaft.

9. Apparatus according to claim 7 or 8, wherein the outlets of the feeding pipes are situated symmetrically or asymmetrically around the rotor shaft.

10. Apparatus according to claim 9, wherein the outlets of each of the feeding pipes are of a non-rotational symmetrical design and at least one of the outlets is provided with an orientation of rotation (V1) in relation to the center of the rotor shaft that differs from the corresponding orientations of rotation (V2) of the other outlets.

11. Apparatus according to claim 1 or 6, wherein the rotor shaft is provided with an axially flow generating element.

12. Apparatus according to claim 11, wherein the axial flow-generating element comprises a number of blades, which are obliquely attached relative to the rotor shaft.

13. Apparatus according to claim 11, wherein the axial flow-generating element comprises a screw thread or a band thread, which extends along the rotor shaft.

14. Apparatus according to claim 1 or 6, wherein the disk is integrated with the rotor shaft.

15. Apparatus according to claim 14, wherein the rotor body comprises an additional number of pins, that extend from the rotor shaft on the down-stream side of the disk, whereby the disk is also fixed to said additional pins.

16. Apparatus according to claim 14, wherein the disk comprises a number of concentric rings which are coaxial with the rotor shaft, and the rotor pins fixate the rings in relation to each other, whereby flow passages are defined by the pins and the rings.

17. Apparatus according to claim 14, wherein spacer elements are arranged between the disk and the rotor pins.

18. Apparatus according to claim 1, wherein each rotor pin is curved forward from the rotor shaft or backward relatively to the rotational direction of the rotor body.

19. Apparatus according to claim 1 or 18, wherein each rotor pin has a width (b), as seen in the rotational direction of the rotor body, that increases along at least a part of the rotor body in a direction against the rotor shaft.

20. Apparatus according to claim 1, wherein said flow-restraining disk includes a center shaft, and each flow passage extends obliquely from the up-stream side of the disk against the center shaft of the disk.

21. Apparatus according to claim 1 or 20, wherein the disk is circular or coaxial to the rotor shaft.

22. Apparatus according to claim 1 or 20, wherein the disk is stationary arranged in the housing.

23. Apparatus according to claim 22, wherein the disk comprises a number of concentric rings which are coaxial with the rotor shaft and at least one radial bar that fixates the rings relative to each other and that are attached in the wall of the housing, whereby the flow passages are defined by the rings and the bar.

* * * * *

UNITED STATES PATENT AND TRADEMARK OFFICE

CERTIFICATE OF CORRECTION

PATENT NO. : 7,384,185 B2
APPLICATION NO. : 10/537939
DATED : June 10, 2008
INVENTOR(S) : Olof Melander, Peter Danielsson and Tomas Wikström It is certified that error appears in the above-identified patent and that said Letters Patent is hereby corrected as shown below:

On the Title Page: Item (57) ABSTRACT, delete the entire Abstract and insert therefor the following:

--Apparatus for mixing a chemical medium with a pulp suspension is disclosed comprising a housing, a first feeder for feeding the pulp suspension to a mixing chamber, a rotor body connected to a rotor shaft to produce turbulence in the mixing chamber, a second feeder for feeding the chemical medium to the mixing chamber, and a flow restraining disk with flow passages arranged in an outlet from the mixing chamber to temporarily increase the flow velocity of the pulp suspension, the rotor body comprising a number of rotor pins extending from the rotor shaft upstream of the disk.--.

Column 5, line 46, “shows” should read --show--.

Signed and Sealed this

Eighteenth Day of August, 2009

David J. Kappos

David J. Kappos
*Director of the United States Patent and Trademark Office*